US009241211B2

(12) United States Patent
Miki et al.

(10) Patent No.: US 9,241,211 B2
(45) Date of Patent: Jan. 19, 2016

(54) TUBULAR BODY, BASS REFLEX PORT, AND ACOUSTIC APPARATUS

(71) Applicant: Yamaha Corporation, Hamamatsu-shi, Shizuoka-ken (JP)

(72) Inventors: Akira Miki, Hamamatsu (JP); Hirofumi Onitsuka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/209,219

(22) Filed: Mar. 13, 2014

(65) Prior Publication Data

US 2014/0262597 A1 Sep. 18, 2014

(30) Foreign Application Priority Data

Mar. 15, 2013 (JP) ..... 2013-054222

(51) Int. Cl.
*H04R 1/28* (2006.01)

(52) U.S. Cl.
CPC ..... *H04R 1/2815* (2013.01)

(58) Field of Classification Search
CPC .. H04R 1/2815; H04R 1/2819; H04R 1/2823; H04R 1/2826
USPC ..... 181/156, 192
See application file for complete search history.

(56) References Cited

U.S. PATENT DOCUMENTS 811,877 A * 2/1906 Senne ..... 181/192
896,672 A * 8/1908 Terhune ..... 181/192
915,013 A * 3/1909 Beecroft ..... 181/192
960,834 A * 6/1910 Cunnius ..... 181/192
1,600,024 A * 9/1926 Walker ..... 181/192
1,855,147 A * 4/1932 Bartlett ..... 181/145
4,210,223 A * 7/1980 Gillum et al. ..... 181/152
D372,874 S * 8/1996 Wong ..... D10/6

(Continued)

FOREIGN PATENT DOCUMENTS

JP 63-52372 A 4/1988
JP H02-44495 A 3/1990

(Continued)

OTHER PUBLICATIONS

Anonymous. (2013). "Monitor Audio," Design for Sound, HiVe II Port Technology, located at: <http://www.monitoraudio.co.uk/biography/technology/hive-ii/>, last visited on Apr. 28, 2014, three pages.

(Continued)

*Primary Examiner* — Jeremy Luks
(74) *Attorney, Agent, or Firm* — Morrison & Foerster LLP

(57) ABSTRACT

A tubular body having an air flow passage, wherein an area of a cross section, in a direction perpendicular to a tube axis, of a space enclosed with an inner wall of the tubular body increases toward an open end thereof, wherein a curvature of the inner wall at an end portion of the tubular body near the open end is repeatedly increased and decreased along a circumferential direction of the inner wall, and wherein, when the inner wall in a cross section of the end portion in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along the circumferential direction.

16 Claims, 5 Drawing Sheets

(56) References Cited

U.S. PATENT DOCUMENTS

| | | | | |
|---|---|---|---|---|
| 5,623,132 | A * | 4/1997 | Gahm | 181/156 |
| 5,991,421 | A * | 11/1999 | Faraone | 381/338 |
| 6,334,505 | B1 | 1/2002 | Li | |
| 7,146,021 | B2 * | 12/2006 | Danovi | 381/432 |
| 2009/0260915 | A1 | 10/2009 | Arai | |

FOREIGN PATENT DOCUMENTS

| | | | |
|---|---|---|---|
| JP | H02-279097 | A | 11/1990 |
| JP | H07-39196 | A | 7/1995 |
| JP | 2003-061177 | A | 2/2003 |
| JP | 2008-048176 | A | 2/2008 |
| JP | 2012-161109 | A | 8/2012 |

OTHER PUBLICATIONS

Notification of Reason for Refusal mailed Feb. 13, 2015 for JP Patent Application No. 2013-054222, with English translation, four pages.

Decision of Refusal mailed Jun. 16, 2015, for Japanese Patent Application No. JP 2013-054222, with English translation, four pages.

* cited by examiner

FIG.1
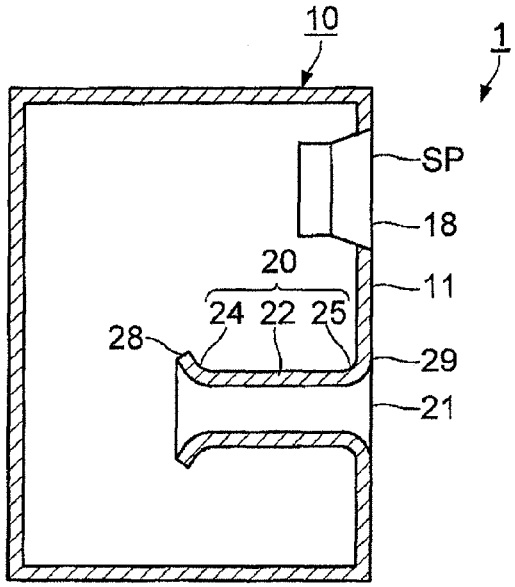
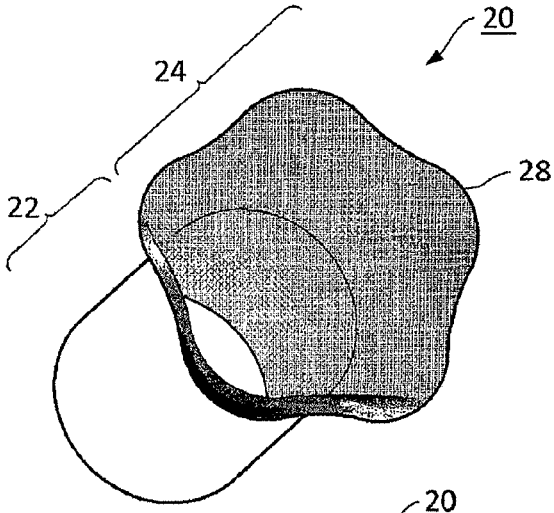
FIG.2A
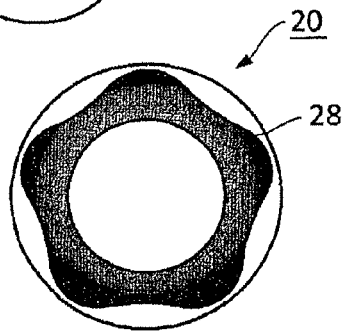
FIG.2B

RELATED ART

RELATED ART

TUBULAR BODY, BASS REFLEX PORT, AND ACOUSTIC APPARATUS

CROSS REFERENCE TO RELATED APPLICATION

The present application claims priority from Japanese Patent Application No. 2013-054222, which was filed on Mar. 15, 2013, the disclosure of which is herein incorporated by reference in its entirety.

BACKGROUND OF THE INVENTION

1. Field of the Invention

The present invention relates to a tubular body, a bass reflex port, and an acoustic apparatus such as a bass reflex speaker.

2. Description of Related art

There is known an acoustic apparatus, such as a bass reflex speaker, configured to enhance the bass positively utilizing sound from the rear of a speaker unit, as disclosed in the following Patent Literature 1. The acoustic apparatus such as the bass reflex speaker includes, in its enclosure (cabinet), a speaker unit and a bass reflex port. The bass reflex port is constituted by a tubular body which is open at its opposite ends and which is fixed at one open end thereof to an opening portion formed in the enclosure of a speaker of the speaker unit. In the acoustic apparatus, air outside the enclosure is suck or taken in into the enclosure via the bass reflex port, and air inside the enclosure is discharged out of the enclosure via the bass reflex port.

FIGS. 7A and 7B are cross-sectional views each showing a structure of a portion of an acoustic apparatus in which a conventional bass reflex port is disposed. As shown in FIG. 7A, a conventional bass reflex port 20A has a cross-sectional shape that is constant dimension from one end to the other end thereof. In the bass reflex port 20A, its inner wall is orthogonal to a baffle panel. The acoustic apparatus having the thus formed bass reflex port 20A suffers from extraneous or abnormal noise (the so-called wind noise) generated from the bass reflex port 20A, which noise arises from suction and discharge of air in the bass reflex port 20A. In view of this, in a conventional bass reflex port 20B shown in FIG. 7B, each of end portions respectively near to opposite ends of the bass reflex port 20B has a flare shape in which an air flow passage via the bass reflex port 20B, namely, a space enclosed with an inner wall of the bass reflex port 20B, gradually widens radially from the middle toward the opposite ends of the bass reflex port 20B, whereby extraneous noise generated from the bass reflex port 20B is reduced.

Patent Literature 1: JP-A-2012-161109

SUMMARY OF THE INVENTION

However, there still remains a problem that extraneous noise is generated from the bass reflex port when sound pressures of sound waves supplied to the bass reflex port are increased by increasing levels of signals supplied to the speaker unit, even where the end portions of the bass reflex port near to the opposite ends are formed to have the flare shape.

The present invention has been developed in view of the above situations. It is therefore an object of the invention to provide a technique of reducing extraneous noise generated from a tubular body such as a bass reflex port.

The object indicated above may be attained according to one aspect of the invention, which provides a tubular body having an air flow passage therein, wherein an area of a perpendicular cross section of a space enclosed with an inner wall of the tubular body increases toward an open end of the tubular body, the perpendicular cross section being a cross section of the space in a direction perpendicular to a tube axis of the tubular body, wherein a curvature of the inner wall at an end portion of the tubular body near the open end is repeatedly increased and decreased along a circumferential direction of the inner wall, and wherein, when the inner wall in a cross section of the end portion in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along the circumferential direction.

The object indicated above may be attained according to another aspect of the invention, which provides a bass reflex port which has open ends at its opposite ends thereof and which is an air flow passage connecting an interior and an exterior of an enclosure of a speaker, wherein an area of a perpendicular cross section of a space enclosed with an inner wall of the bass reflex port having a tubular shape increases in directions toward the open ends of the bass reflex port, the perpendicular cross section being a cross section of the space in a direction perpendicular to a tube axis of the bass reflex port, wherein one of the open ends of the bass reflex port is fixed to an opening portion formed in a baffle board of the enclosure, wherein a curvature of the inner wall at at least one of a first end portion that is near to the one of the open ends and a second end portion that is near to the other of the open ends is repeatedly increased and decreased along a circumferential direction of the inner wall, and wherein, when the inner wall in a cross section of the at least one of the first end portion and the second end portion in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along the circumferential direction.

The object indicated above may be attained according to still another aspect of the invention, which provides an acoustic apparatus comprising: a cabinet having an opening portion; and a tubular body which is disposed in the cabinet and which has open ends at its opposite ends, one of the open ends of the tubular body being fixed to the opening portion of the cabinet so as to form an air flow passage connecting an interior and an exterior of the cabinet, wherein an area of a perpendicular cross section of a space enclosed with an inner wall of the tubular body increases in directions toward the open ends of the tubular body, the perpendicular cross section being a cross section of the space in a direction perpendicular to a tube axis of the tubular body, wherein a curvature of the inner wall at at least one of a first end portion that is near to the one of the open ends and a second end portion that is near to the other of the open ends is repeatedly increased and decreased along a circumferential direction of the inner wall, and wherein, when the inner wall in a cross section of the at least one of the first end portion and the second end potion in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along the circumferential direction.

According to the present invention, it is possible to reduce extraneous noise generated from the tubular body or the bass reflex port when air flows into and out of the tubular body passing therethrough.

FORMS OF THE INVENTION

There will be described various forms of the invention.

A tubular body (20) having an air flow passage therein, wherein an area of a perpendicular cross section of a space enclosed with an inner wall of the tubular body increases toward an open end (28) of the tubular body, the perpendicular cross section being a cross section of the space in a direction perpendicular to a tube axis of the tubular body, wherein a curvature of the inner wall at an end portion (24) of the tubular body near the open end is repeatedly increased and decreased along a circumferential direction of the inner wall, and wherein, when the inner wall in a cross section of the end portion in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along the circumferential direction.

In the tubular body constructed as described above, the convex portion and the concave portion may be repeated five times along the circumferential direction.

In the tubular body constructed as described above, the convex portion and the concave portion may be repeated seven times along the circumferential direction.

In the tubular body constructed as described above, the convex portion and the concave portion may be repeatedly formed a plurality of times along the circumferential direction, so that the inner wall has a plurality of convex portions and a plurality of concave portions that provide a plurality of pairs of convex portions and concave portions, and the plurality of pairs of convex portions and concave portions may be formed at a plurality of intervals along the circumferential direction and at least two of the plurality of intervals may be mutually the same.

In the tubular body constructed as described above, the plurality of intervals may be mutually the same.

In the tubular body constructed as described above, at least two of the plurality of intervals may be mutually different.

In the tubular body constructed as described above, the convex portion and the concave portion may be repeatedly formed a plurality of times along the circumferential direction, so that the inner wall has a plurality of convex portions and a plurality of concave portions, and the plurality of concave portions may be formed such that an interval between any successive two concave portions is constant.

In the tubular body constructed as described above, the convex portion and the concave portion may be repeatedly formed a plurality of times along the circumferential direction, so that the inner wall has a plurality of convex portions and a plurality of concave portions, and the plurality of convex portions and the plurality of concave portions may be alternately formed at a constant pitch.

The tubular body constructed as described above may comprise: a straight portion (22) and a flare portion (24, 25), as the end portion, located at at least one of opposite ends of the straight portion in a direction along the tube axis. In the straight portion, the area of the perpendicular cross section of the space enclosed with the inner wall of the tubular body may be constant in the direction along the tube axis. In the flare portion, the area of the perpendicular cross section of the space enclosed with the inner wall of the tubular body may increase in a direction away from the straight portion. The convex portion and the concave portion may be repeatedly formed on the inner wall of the flare portion along the circumferential direction.

The tubular body constructed as described above may comprise: a straight portion (22) and two flare portions (24, 25), each as the end portion, located at one and the other of opposite sides of the straight portion in a direction along the tube axis. In the straight portion, the area of the perpendicular cross section of the space enclosed with the inner wall of the tubular body may be constant in the direction along the tube axis. In each of the two flare portions, the area of the perpendicular cross section of the space enclosed with the inner wall of the tubular body may increase in a direction away from the straight portion. The convex portion and the concave portion may be repeatedly formed on the inner wall of one (24) of the two flare portions along the circumferential direction and may not be formed on the inner wall of the other (25) of the two flare portions.

In the tubular body constructed as described above, the tubular body may be a bass reflex port (20).

A bass reflex port (20) which has open ends (28, 29) at its opposite ends thereof and which is an air flow passage connecting an interior and an exterior of an enclosure (10) of a speaker, wherein an area of a perpendicular cross section of a space enclosed with an inner wall of the bass reflex port having a tubular shape increases in directions toward the open ends of the bass reflex port, the perpendicular cross section being a cross section of the space in a direction perpendicular to a tube axis of the bass reflex port, wherein one (29) of the open ends of the bass reflex port is fixed to an opening portion (21) formed in a baffle board (11) of the enclosure, wherein a curvature of the inner wall at at least one of a first end portion (25) that is near to the one (29) of the open ends and a second end portion (24) that is near to the other (28) of the open ends is repeatedly increased and decreased along a circumferential direction of the inner wall, and wherein, when the inner wall in a cross section of the at least one of the first end portion and the second end portion in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along the circumferential direction.

In the bass reflex port constructed as described above, the convex portion and the concave portion may be repeatedly formed on the inner wall of the second end portion (24) that is near to the other (28) of the open ends along the circumferential direction and may not be formed on the inner wall of the first end portion (25) that is near to the one (29) of the open ends.

An acoustic apparatus comprising: a cabinet (10) having an opening portion (21); and a tubular body (20) which is disposed in the cabinet and which has open ends (28, 29) at its opposite ends, one (29) of the open ends of the tubular body being fixed to the opening portion of the cabinet so as to form an air flow passage connecting an interior and an exterior of the cabinet, wherein an area of a perpendicular cross section of a space enclosed with an inner wall of the tubular body increases in directions toward the open ends of the tubular body, the perpendicular cross section being a cross section of the space in a direction perpendicular to a tube axis of the tubular body, wherein a curvature of the inner wall at at least one of a first end portion (25) that is near to the one (29) of the open ends and a second end portion (24) that is near to the other (28) of the open ends is repeatedly increased and decreased along a circumferential direction of the inner wall, and wherein, when the inner wall in a cross section of the at least one of the first end portion and the second end potion in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along the circumferential direction.

In the acoustic apparatus constructed as described above, the convex portion and the concave portion may be repeatedly formed on the inner wall of the second end portion (24) that is near to the other (28) of the open ends along the circumferential direction and may not be formed on the inner wall of the first end portion (25) that is near to the one (29) of the open ends.

The reference numerals in the brackets attached to respective constituent elements in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which:

FIG. 1 is a cross-sectional view showing a structure of an acoustic apparatus 1 according to one embodiment of the invention;

FIG. 2A is a perspective view and FIG. 2B is a front view each showing a flare portion 24 of a bass reflex port 20 when viewed from an inside of an enclosure 10 of the acoustic apparatus 1;

DETAILED DESCRIPTION OF THE EMBODIMENTS

Figure 3:
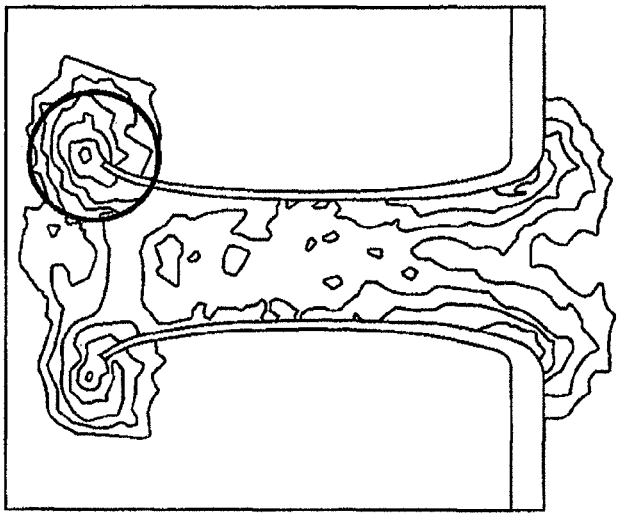
FIG.3 RELATED ART
FIG. 3 is a view showing a simulation result of magnitude of air turbulence in a conventional bass reflex port whose opposite end portions have a flare shape.

There will be hereinafter explained embodiments of the present invention with reference to the drawings.

Embodiment

FIG. 1 is a cross-sectional view showing a structure of an acoustic apparatus 1 according to one embodiment of the invention. As shown in FIG. 1, the acoustic apparatus 1 includes an enclosure 10, a speaker unit SP, and a bass reflex port 20. The bass reflex port 20 and the enclosure 10 constitute a Helmholtz resonator having a resonance frequency in the neighborhood of the lowest frequency in a frequency band in which the sound pressure is flat in the output characteristics of the acoustic apparatus 1.

The enclosure 10 is a rectangular parallelepiped constituted by six panels. One of the six panels of the enclosure 10, namely, a front panel 11, that functions as a baffle panel has two opening portions 18, 21. In the opening portion 18, the speaker unit SP is provided.

The bass reflex port 20 is a hollow tubular body having a substantially cylindrical shape. The bass reflex port 20 is constituted by: a straight portion 22 in which a cross-sectional area (i.e., an area of a cross section, in a direction perpendicular to the axis of the bass reflex port 20, of a space enclosed with an inner wall of the bass reflex port 20) is constant in a direction in which the axis extends (hereinafter referred to as "tube axis direction" where appropriate); and a flare portion 24 (as one example of a second end portion) and a flare portion 25 (as one example of a first end portion) located on one and the other of opposite sides of the straight portion 22. The flare portion 25 has a flare shape in which the cross-sectional area gradually increases from the proximity of a boundary between the straight portion 22 and the flare portion 25 toward an open end 29. The open end 29 of the bass reflex port 20 on the side of the flare portion 25 is fixed to the opening portion 21 of the front panel 11 that functions as the baffle panel.

FIG. 2A is a perspective view of the flare portion 24 of the bass reflex port 20 when viewed from an inside of the enclosure 10 of the acoustic apparatus 1. FIG. 2B is a front view of an open end 28 of the bass reflex port 20 on the side of the flare portion 24. As shown in FIGS. 2A and 2B, the flare portion 24 has a shape like a funnelform corolla of flowers of a convolvulus, a sweet potato, and the like (hereinafter simply referred to as "corolla shape" where appropriate. More specifically, the flare portion 24 has a shape in which the cross-sectional area gradually increases from the proximity of a boundary between the straight portion 22 and the flare portion 24 toward the open end 28 and in which a curvature of the inner wall is repeatedly increased and decreased along the circumferential direction of the flare portion 24 about the tube axis. Accordingly, the inner wall of the flare portion 24 near the open end 28 has a portion in which the center of curvature of the inner wall in a cross section in the direction perpendicular to the tube axis is located on one of radially opposite sides of the inner wall that is nearer to the tube axis and a portion in which the center of curvature of the inner wall is located on the other of the radially opposite sides of the inner wall that is remote from the tube axis, and these portions are repeatedly formed along the circumferential direction of the inner wall. In other words, when the inner wall in a cross section, in the direction perpendicular to the tube axis, of an end portion of the bass reflex port 20 that is near to the open end 28 (as one example of the second end portion) is viewed from the tube axis, a convex portion at which the inner wall protrudes in a direction away from the tube axis and a concave portion at which the inner wall is recessed in a direction toward the tube axis are repeatedly formed along the circumferential direction of the inner wall. Where it is defined that the curvature, along the circumferential direction, of the convex portion of the inner wall (as viewed from the tube axis as indicated above) is a positive curvature and the curvature, along the circumferential direction, of the concave portion of the inner wall (as viewed from the tube axis as indicated above) is a negative curvature, the curvature of the inner wall along the circumferential direction may be expressed as repetition of the positive curvature and the negative curvature. It is noted that values of the curvature of the inner wall along the circumferential direction are determined by simulation or the like on the basis of individual dimensions of the bass reflex port 20.

The flare portion 24 and the flare portion 25 may be formed integrally with the straight portion 22. Alternatively, the flare portion 24 and the flare portion 25 that are separate from the straight portion 22 upon production may be fixed to the straight portion 22 after production.

The structure of the acoustic apparatus 1 has been explained hereinabove.

FIG. 3 is an elevational view in vertical cross section showing a simulation result of magnitude of air turbulence (vortex) in a conventional bass reflex port. According to the simulation result shown in FIG. 3, air turbulence (vortex) is generated in a wide range in the vicinity of an outer end of the bass reflex port (i.e., an open end facing the outside of an enclosure) while air turbulence (vortex) is generated locally in a narrow range in the vicinity of an inner end of the bass reflex port (i.e., an open end located in the inside of the enclosure).

Figure 5A:
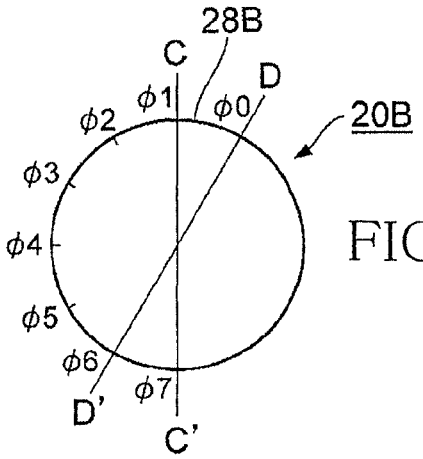
FIGS. 5A-5D are views for explaining air flows along an inner wall in the vicinity of an open end 28B of a conventional bass reflex port 20B.
Figure 5B:
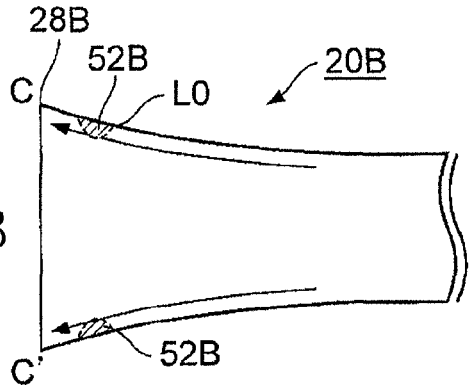
Figure 5C:
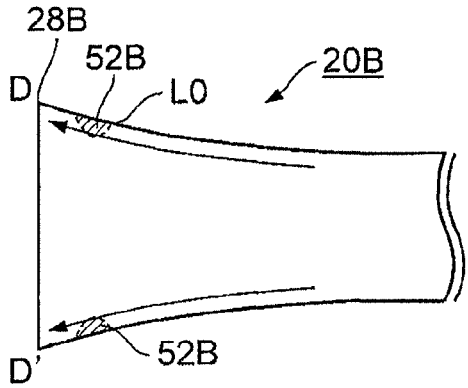
Figure 5D:
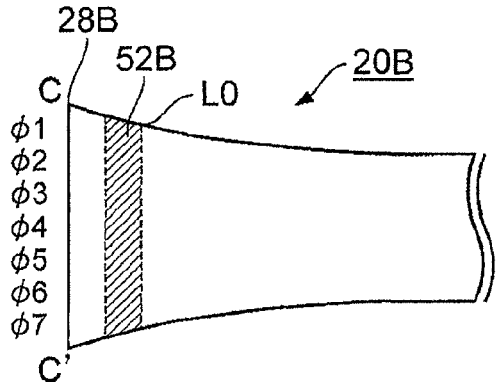
Figure 7A:
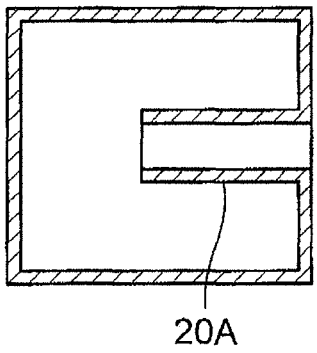
FIGS. 7A and 7B are cross-sectional views each showing a structure of a portion of an acoustic apparatus in which a conventional bass reflex port is disposed.
Figure 7B:
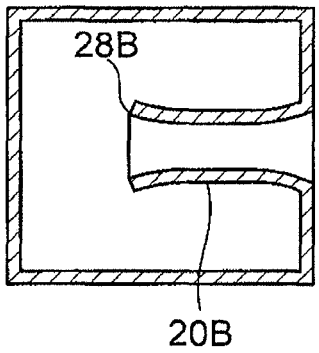

Referring to FIGS. 5A-5D, there will be explained in detail air flows along the inner wall in the vicinity of an open end 28B (inner end) of a conventional bass reflex port 20B shown in FIG. 7B. FIG. 5A is a cross-sectional view perpendicular to the tube axis at the open end 28B of the bass reflex port 20B. FIG. 5B is a view showing a cross section including the tube axis and taken along the line C-C' in FIG. 5A. FIG. 5C is a view showing a cross section including the tube axis and taken along the line D-D' in FIG. 5A. FIG. 5D is a side view when a left-side portion of the inner wall in FIG. 5A is viewed from the cross section taken along the line C-C' in FIG. 5A.

As shown in FIG. 5A, the cross-sectional shape of the inner wall at the open end 28B of the conventional bass reflex port 20B is a circle. FIG. 5B shows a vertical cross-sectional structure when the bass reflex port 20B of FIG. 5A is cut on a plane that includes the tube axis of the bass reflex port 20B and that includes positions $\phi$1 and $\phi$7 at the open end 28B in the circumferential direction. As shown in FIG. 5B, when the air flows from an inside of the bass reflex port 20B to an outside of the bass reflex port 20B, namely, to an inside of the enclosure, the air existing near the inner wall at an end portion of the bass reflex port 20B near the open end 28B flows along the inner wall. In this instance, because the air flow area becomes larger toward the downstream side of the air flow, there is formed, in the vicinity of the open end 28, adverse pressure gradient in which the pressure on the downstream side is high. The air flows near the inner wall at which the adverse pressure gradient is formed lose energy due to friction with the inner wall, and it is accordingly difficult for the air flows to go further toward the downstream side against the pressure. As a result, the air flows separate from the inner wall of the bass reflex port 20B. In the vicinity of the inner wall on the downstream side of the position at which the air flows separate from the inner wall, there is generated back-flow that causes air turbulence (vortex). The position at which the air flows separate from the inner wall is determined based on various conditions such as a degree of increase in the flow area along a direction toward the downstream side. In FIG. 5B, the air flows separate from the inner wall of the bass reflex port 20B at a position L0 in the tube axis direction of the bass reflex port 20B and there are generated regions 52B in which air turbulence (vortex) occurs. (Hereinafter, the region 52B will be referred to as "turbulence (vortex) region 52B" where appropriate.)

FIG. 5C shows a vertical cross-sectional structure when the bass reflex port 20B of FIG. 5A is cut on a plane that includes the tube axis of the bass reflex port 20B and that includes positions $\phi$0 and $\phi$6 at the open end 28B in the circumferential direction. Because the cross-sectional shape of the open end 28B is a circle, the cross section shown in FIG. 5C is identical with the cross section shown in FIG. 5B. Accordingly, also in FIG. 5C, the air flows separate from the inner wall of the bass reflex port 20B at the position L0 in the tube axis direction of the bass reflex port 20B, and there are generated regions 52B in which air turbulence (vortex) occurs, as in FIG. 5B.

In FIG. 5D, positions $\phi$1-$\phi$7 that respectively correspond to the positions $\phi$1-$\phi$7 in the circumferential direction shown in FIG. 5A (hereinafter referred to as "circumferential positions" where appropriate) are indicated on the left side of the line C-C'. Because the cross-sectional shape of the open end 28B is a circle, the cross sections at the respective circumferential positions $\phi$1-$\phi$7 are identical with those shown in FIGS. 5B and 5C. Accordingly, the turbulence (vortex) regions 52B at the respective circumferential positions $\phi$1-$\phi$7 are generated at the same position L0 in the tube axis direction of the bass reflex port 20B. That is, in the conventional bass reflex port 20B, the regions in which air turbulence (vortex) occurs are distributed locally in a narrow range in the tube axis direction when observed throughout the circumferential direction.

Where the regions in which air turbulence (vortex) occurs are generated in the narrow range, air turbulence (vortex) in substantially the same phase occurs at the same time at substantially the same position in the tube axis direction of the bass reflex port. Therefore, the magnitude (intensity) of air turbulence (vortex) in the entirety of the regions is large. In this instance, tube resonance (pipe resonance) of the bass reflex port is strongly excited, so that large extraneous or abnormal noise is generated from the bass reflex port. Accordingly, if air turbulence (vortex) can be prevented from occurring locally, excitation of the tube resonance of the bass reflex port is suppressed, whereby extraneous noise can be reduced. In view of this, in the acoustic apparatus 1 according to the present embodiment, the bass reflex port 20 is formed to have the corolla shape in the vicinity of its inner end, namely, in the vicinity of the open end 28 located in the inside of the enclosure 10.

Figure 4:
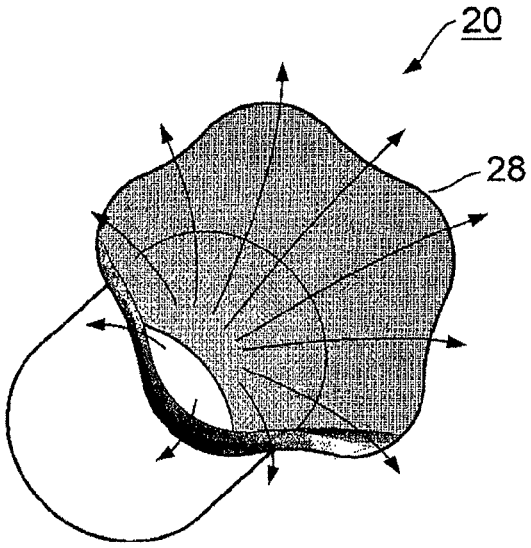
FIG. 4 is a perspective view showing air flows in the vicinity of an open end 28 of the bass reflex port 20 of the acoustic apparatus 1.

There will be next explained air flows in the vicinity of the open end 28 of the bass reflex port 20 of the acoustic apparatus 1 according to the present embodiment. When drive signals are supplied to the speaker unit SP of the acoustic apparatus 1 and the speaker unit SP is activated, the air on the rear of the speaker unit SP vibrates and the air moves between the inside and the outside of the enclosure 10 via the bass reflex port 20. FIG. 4 is a perspective view showing air flows in the vicinity of the open end 28 of the bass reflex port 20 when the air in the inside of the bass reflex port 20 is sucked or taken in into the enclosure 10. As shown in FIG. 4, the air in the vicinity of the open end 28 of the bass reflex port 20 flows along the inner wall having the corolla shape.

Figure 6A:
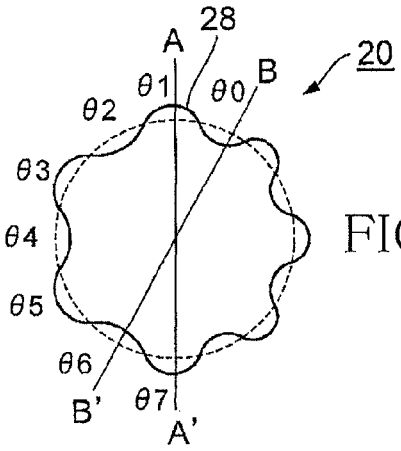
FIGS. 6A-6D are views for explaining air flows along an inner wall in the vicinity of the open end 28 of the bass reflex port 20 of the acoustic apparatus 1.
Figure 6B:
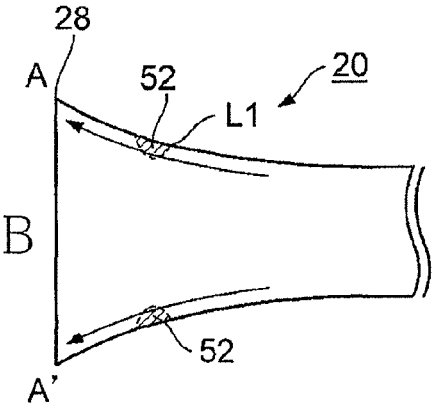
Figure 6C:
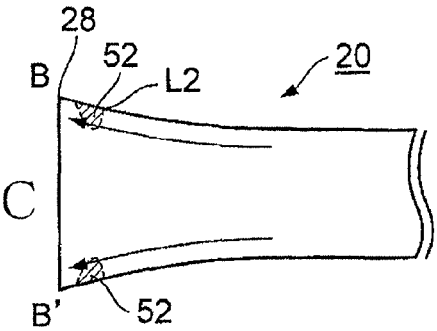
Figure 6D:
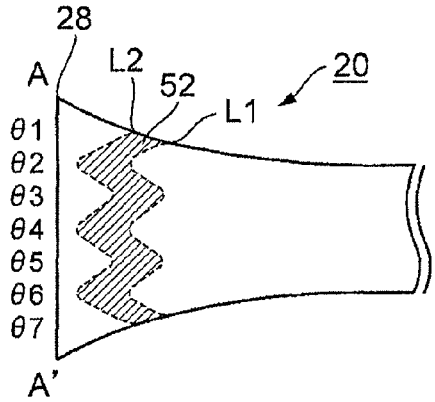

Referring to FIGS. 6A-6D, there will be explained in detail air flows along the inner wall in the vicinity of the open end 28 of the bass reflex port 20 according to the present embodiment. FIG. 6A is a cross-sectional view perpendicular to the tube axis at the open end 28. FIG. 6B is a view showing a cross section including the tube axis and taken along the line A-A' in FIG. 6A. FIG. 6C is a view showing a cross section including the tube axis and taken along the line B-B' in FIG. 6A. FIG. 6D is a side view when a left-side portion of the inner wall in FIG. 6A is viewed from the cross section taken along the line A-A'. In FIG. 6, the number of repetition of increase and decrease in the curvature along the circumferential direction differs from that in FIGS. 2 and 4 for convenience in explanation.

As shown in FIG. 6A, the inner wall at the open end 28 of the bass reflex port 20 according to the present embodiment has a cross-sectional shape in which, when the inner wall is viewed from the tube axis, the convex portion at which the inner wall protrudes in the direction away from the tube axis and the concave portion at which the inner wall is recessed in the direction toward the tube axis are repeatedly formed along the circumferential direction of the inner wall. In other words, regarding the inner wall in the cross section of the open end 28, the center of curvature of the inner wall at the convex portion that protrudes outward of a circle (indicated by the broken line in FIG. 6A) having its center on the tube axis is located on one of opposite sides of the inner wall that is nearer to the tube axis, and the curvature, along the circumferential direction, of the inner wall at the convex portion takes a positive value. On the other hand, the center of curvature of the inner wall at the concave portion that is recessed inward of the above-indicated circle is located on the other of the opposite sides of the inner wall that is remote from the tube axis, and the curvature, along the circumferential direction, of the inner wall at the concave portion takes a negative value. FIG. 6B shows the inner wall in the tube axis direction corresponding to positions θ1 and θ7 (FIG. 6A) at the open end 28 in the circumferential direction (hereinafter referred to as "circumferential positions" where appropriate). As shown in FIGS. 6A and 6B, each of the circumferential positions θ1 and θ7 is the convex portion of the inner wall that protrudes in the direction away from the tube axis when the inner wall is viewed from the tube axis, and the open end 28 widens largely at the circumferential positions θ1 and θ7. Accordingly, at the circumferential positions θ1 and θ7, a degree of increase in the flow area, namely, a degree of enlargement of the air flow passage, becomes large in a direction from the middle of the bass reflex port 20 toward the open end 28. Therefore, at the circumferential positions θ1 and θ7, the air flows existing near the inner wall separate therefrom at a position L1 in the tube axis direction of the bass reflex port 20, and there are generated regions 52 in which air turbulence (vortex) occurs, as shown in FIG. 6B. (Hereinafter, the region 52 will be referred to as "turbulence (vortex) region 52" where appropriate.)

Like the circumferential positions θ1 and θ7, each of circumferential positions θ3 and θ5 is the convex portion of the inner wall that protrudes in the direction away from the tube axis when the inner wall is viewed from the tube axis. Accordingly, the turbulence (vortex) regions 52 are generated at the position L1 in the tube axis direction, as in FIG. 6B.

FIG. 6C shows the inner wall in the tube axis direction at circumferential positions θ0 and θ6 (FIG. 6A). As shown in FIGS. 6A and 6C, each of the circumferential positions θ0 and θ6 is the concave portion that is recessed in the direction toward the tube axis when the inner wall is viewed from the tube axis, and the open end 28 widens at the circumferential positions θ0 and θ6 to a smaller extent, as compared with the convex portion. Accordingly, at the circumferential positions θ0 and θ6, the degree of increase in the flow area, namely, the degree of enlargement of the air flow passage, becomes small in a direction from the middle of the bass reflex port 20 toward the open end 28. Therefore, at the circumferential positions θ0 and θ6, the air flows separate from the inner wall at a position L2 in the tube axis direction and the turbulence (vortex) regions 52 are generated, as shown in FIG. 6C.

Like the circumferential positions θ0 and θ6, each of circumferential positions θ2 and θ4 is the concave portion of the inner wall that is recessed in the direction toward the tube axis when the inner wall is viewed from the tube axis. Accordingly, the turbulence (vortex) regions 52 are generated at the position L2 in the tube axis direction, as in FIG. 6C.

In FIG. 6D, positions θ1-θ7 that respectively correspond to the circumferential positions θ1-θ7 in FIG. 6A are indicated on the left side of the line A-A'. As shown in FIG. 6D, at the positions θ1, θ3, θ5, and θ7 where the inner wall protrudes convexly in the direction away from the tube axis, the turbulence (vortex) regions 52 are generated at the position L1 in the tube axis direction. On the other hand, at the positions θ0, θ2, θ4, and θ6 where the inner wall is recessed concavely in the direction toward the tube axis, the turbulence (vortex) regions 52 are generated at the position L2 in the tube axis direction. Further, at positions each between any adjacent two of the circumferential positions θ0-θ7, the turbulence (vortex) region 52 is generated at positions each between the position L1 and the position L2 in the tube axis direction. That is, the turbulence (vortex) regions 52 are generated at respective positions in the tube axis direction that correspond to the curvatures along the circumferential direction, namely, the positions corresponding to the respective curvature centers or the sign (positive or negative) of the curvatures. The turbulence (vortex) regions 52 are distributed in the form of a wave which has amplitude in the tube axis direction and whose traveling direction coincides with the circumferential direction. Therefore, in the vicinity of the open end 28 of the present bass reflex port 20, namely, at the end portion of the bass reflex port 20 near the open end 28, the turbulence (vortex) regions 52 in which air turbulence (vortex) occurs are distributed in a wide range in the tube axis direction when observed throughout the circumferential direction.

There will be next explained differences between the present bass reflex port 20 and a conventional bass reflex port having, in the vicinity of the open end, a rectangular or elliptical cross section perpendicular to the tube axis. In the conventional bass reflex port having the rectangular cross section, the curvature of the inner wall along its periphery is constant in each of four sides of the rectangle. In this respect, the conventional bass reflex port having the rectangular cross section is similar to the conventional bass reflex port having the circular cross section described above. In the conventional bass reflex port having the elliptical cross section, although the curvature of the inner wall along the circumferential direction changes, a degree of the change in the curvature is small. Further, the position of the center of curvature of the inner wall is not located on one of opposite sides of the inner wall that is remote from the tube axis, and the inner wall is not recessed in a direction toward the tube axis when the inner wall is viewed from the tube axis. In the conventional bass reflex port having the elliptical cross section and the present bass reflex port 20, a plurality of curvatures along the inner circumferential direction are continuous in the inner circumferential direction in the cross section perpendicular to the tube axis. In the conventional bass reflex port having the elliptical cross section, the degree of change in the curvatures along the inner circumferential direction is smaller than that in the present bass reflex port 20. Accordingly, the position in the tube axis direction at which the turbulence (vortex) regions are generated does not largely change in the conventional bass reflex port having the elliptical cross section. Therefore, it is considered that, in the conventional bass reflex port having the elliptical cross section, the turbulence (vortex) regions at respective circumferential positions are likely to be generated locally at substantially the same position in the tube axis direction. In contrast, in the present bass reflex port 20, the curvature of the inner wall in the vicinity of the open end 28, i.e., the curvature of the end portion of the bass reflex port 20 near the open end 28, is repeatedly increased and decreased along the circumferential direction. Further, when the inner wall in the cross section, in the direction perpendicular to the tube axis, of the end portion of the bass reflex port 20 that is near the open end 28 is viewed from the tube axis, the convex portion at which the inner wall protrudes in the direction away from the tube axis and the concave portion at which the inner wall is recessed in the direction toward the tube axis are repeatedly formed along the circumferential direction of the inner wall. Therefore, the curvature along the circumferential direction largely changes and the position in the tube axis direction at which the turbulence (vortex) regions are generated largely changes. Accordingly, in the present bass reflex port 20, the turbulence (vortex) regions 52 at which turbulence (vortex) occurs are distributed in a wide range in the tube axis direction.

In the acoustic apparatus 1 according to the present embodiment, the inner wall of the bass reflex port 20 in the vicinity of the open end 28, namely, the inner wall at the end portion of the bass reflex port 20 near the open end 28, has the corolla shape in which the cross-sectional area (i.e., the area of the cross section, in the direction perpendicular to the axis of the bass reflex port 20, of the space enclosed with then inner wall of the bass reflex port 20) gradually increases toward the open end 28 of the bass reflex port 20 and in which the curvature of the inner wall is repeatedly increased and decreased along the circumferential direction, so that, when the inner wall in the cross section of the vicinity of the open end 28 in the direction perpendicular to the tube axis is viewed from the tube axis, the convex portion at which the inner wall protrudes in the direction away from the tube axis and the concave portion at which the inner wall is recessed in the direction toward the tube axis are repeatedly formed along the circumferential direction of the inner wall. The thus configured bass reflex port 20 prevents the regions at which air turbulence (vortex) occurs from being generated locally in the air flow passage via the bass reflex port 20. Therefore, it is possible to prevent generation of extraneous noise which arises from suction and discharge of the air in the bass reflex port 20.

Other Embodiments

While there has been explained one embodiment of the invention, it is to be understood that the invention may be embodied otherwise. Other embodiments will be explained below.

(1) In the bass reflex port 20 of the acoustic apparatus 1 according to the embodiment, the corolla shape is illustrated as one example of the shape of the inner wall that changes in the circumferential direction. The shape of the inner wall is not limited to the illustrated shape. It is essential that the inner wall have a shape in which the curvature of the inner wall in the vicinity of the open end 28 of the bass reflex port 20 is repeatedly increased and decreased along the circumferential direction of the inner wall. Further, repetition intervals of increase and decrease in the curvature of the inner wall along the circumferential direction need not be constant along the circumferential direction. In other words, while the convex portions and the concave portions are alternately formed at a constant pitch in the illustrated embodiment, the pitch may change in the circumferential direction. Further, the number of repetition of curvature increase and curvature decrease (the number of repetition of the convex portion and the concave portion of the inner wall) may be one or plural.

(2) The bass reflex port 20 may be configured such that the bass reflex port 20 has the corolla shape in the vicinity of the open end 28 and such that the cross section in the vicinity of the open end 28 does not have point symmetry or axial symmetry. By thus forming the cross section in the vicinity of the open end 28 so as not to have point symmetry or axial symmetry, it is possible to distribute, with high reliability, the turbulence (vortex) regions 52 in a wide range in the tube axis direction.

(3) The bass reflex port 20 of the acoustic apparatus 1 in the illustrated embodiment has the corolla shape in the vicinity of the open end 28, namely, at the end portion of the bass reflex port 20 near the open end 28. The bass reflex port 20 may have the corolla shape in the vicinity of the open end 29, namely, at the end portion of the bass reflex port 20 near the open end 29. The bass reflex port 20 may have the corolla shape at both of the end portion (second end portion) near the open end 28 and the end portion (first end portion) near the open end 29. By forming the both of the end portions so as to have the corolla shape, for instance, it is possible to distribute, with high reliability, the turbulence (vortex) regions in a wide range, thereby suppressing generation of extraneous noise with high reliability.

(4) In the illustrated embodiment, the tube axis of the bass reflex port 20 is straight. The tube axis is not limited to the straight one. For instance, the tube axis may be curved in the vicinity of the middle of the bass reflex port 20.

(5) In the illustrated embodiment, the open end 28 of the bass reflex port 20 is in contact with the plane orthogonal to the tube axis. However, the open end 28 located in the inside of the enclosure 10 may be configured to be in contact with a plane that is inclined relative to the plane orthogonal to the tube axis, for instance.

(6) The straight portion 22 of the bass reflex port 20 in the acoustic apparatus 1 according to the illustrated embodiment has a circular cross section on the plane perpendicular to the tube axis. However, the structure of the straight portion 22 of the bass reflex port 20 is not limited to the one having the circular cross section. For instance, the straight portion 22 of the bass reflex port 20 may have a rectangular cross section.

(7) In the illustrated embodiment, the bass reflex port 20 is constituted by the straight portion 22, the flare portion 24, and the flare portion 25. The bass reflex port 20 may be configured such that its cross sectional area continuously increases in directions from the middle toward the opposite ends, without providing the straight portion 22.

(8) The technical concept of the present invention resides in the technique of reducing extraneous noise generated from the tubular body functioning as an air flow passage, such as the bass reflex port 20. The invention is characterized in that the cross-sectional area of the space enclosed with the inner wall of the tubular body perpendicular to the tube axis gradually increases in the vicinity of the open end in a direction toward the open end of the tubular body functioning as the air flow passage and that the curvature of the inner wall is repeatedly increased and decreased along the circumferential direction. Accordingly, the invention is applicable to mufflers of two-wheeled vehicles and four-wheeled vehicles, intake/exhaust ducts of air conditioning systems, musical instruments, and so on.

What is claimed is:

1. A tubular body having an air flow passage therein, wherein an area of a perpendicular cross section of a space enclosed with an inner wall of the tubular body increases toward an open end of the tubular body, the perpendicular cross section being a cross section of the space in a direction perpendicular to a tube axis of the tubular body, wherein, when the inner wall in a cross section of an end portion of the tubular body in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along a circumferential direction of the inner wall, and wherein, in each of the convex portion and the concave portion, a curvature of the inner wall of the tubular body near the open end is increased and decreased along the circumferential direction of the inner wall.

2. The tubular body according to claim 1, wherein the convex portion and the concave portion are repeated five times along the circumferential direction.

3. The tubular body according to claim 1, wherein the convex portion and the concave portion are repeated seven times along the circumferential direction.

4. The tubular body according to claim 1, wherein the convex portion and the concave portion are repeatedly formed a plurality of times along the circumferential direction, so that the inner wall has a plurality of convex portions and a plurality of concave portions that provide a plurality of pairs of convex portions and concave portions, and wherein the plurality of pairs of convex portions and concave portions are formed at a plurality of intervals along the circumferential direction and at least two of the plurality of intervals are mutually the same.

5. The tubular body according to claim 4, wherein the plurality of intervals are mutually the same.

6. The tubular body according to claim 1, wherein the convex portion and the concave portion are repeatedly formed a plurality of times along the circumferential direction, so that the inner wall has a plurality of convex portions and a plurality of concave portions, and wherein the plurality of concave portions are formed such that an interval between any successive two concave portions is constant.

7. The tubular body according to claim 1, wherein the convex portion and the concave portion are repeatedly formed a plurality of times along the circumferential direction, so that the inner wall has a plurality of convex portions and a plurality of concave portions, and wherein the plurality of convex portions and the plurality of concave portions are alternately formed at a constant pitch.

8. The tubular body according to claim 1, comprising: a straight portion and a flare portion, as the end portion, located at at least one of opposite ends of the straight portion in a direction along the tube axis, wherein, in the straight portion, the area of the perpendicular cross section of the space enclosed with the inner wall of the tubular body is constant in the direction along the tube axis, wherein, in the flare portion, the area of the perpendicular cross section of the space enclosed with the inner wall of the tubular body increases in a direction away from the straight portion, and wherein the convex portion and the concave portion are repeatedly formed on the inner wall of the flare portion along the circumferential direction.

9. The tubular body according to claim 1, comprising: a straight portion and two flare portions, each as the end portion, located at one and the other of opposite sides of the straight portion in a direction along the tube axis, wherein, in the straight portion, the area of the perpendicular cross section of the space enclosed with the inner wall of the tubular body is constant in the direction along the tube axis, wherein, in each of the two flare portions, the area of the perpendicular cross section of the space enclosed with the inner wall of the tubular body increases in a direction away from the straight portion, and wherein the convex portion and the concave portion are repeatedly formed on the inner wall of one of the two flare portions along the circumferential direction and are not formed on the inner wall of the other of the two flare portions.

10. The tubular body according to claim 1, wherein the tubular body is a bass reflex port.

11. The tubular body according to claim 1, wherein an end of the convex portion and an end of the convex portion are connected to each other at a connecting point, wherein, from the convex portion toward the concave portion through the connecting point along the circumferential direction, the curvature of the inner wall varies continuously.

12. The tubular body according to the claim 1, wherein the inner wall of the convex portion and the inner wall of the concave portion are connected to each other smoothly.

13. A bass reflex port which has open ends at its opposite ends thereof and which is an air flow passage connecting an interior and an exterior of an enclosure of a speaker, wherein an area of a perpendicular cross section of a space enclosed with an inner wall of the bass reflex port having a tubular shape increases in directions toward the open ends of the bass reflex port, the perpendicular cross section being a cross section of the space in a direction perpendicular to a tube axis of the bass reflex port, wherein one of the open ends of the bass reflex port is fixed to an opening portion formed in a baffle board of the enclosure, wherein, when the inner wall in a cross section of at least one of a first end portion that is near to the one of the open ends and a second end portion that is near to the other of the open ends in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along a circumferential direction of the inner wall, and wherein, in each of the convex portion and the concave portion, a curvature of the inner wall at the at least one of the first end portion and the second end portion is increased and decreased along the circumferential direction of the inner wall.

14. The bass reflex port according to claim 13, wherein the convex portion and the concave portion are repeatedly formed on the inner wall of the second end portion that is near to the other of the open ends along the circumferential direction and are not formed on the inner wall of the first end portion that is near to the one of the open ends.

15. An acoustic apparatus comprising: a cabinet having an opening portion; and a tubular body which is disposed in the cabinet and which has open ends at its opposite ends, one of the open ends of the tubular body being fixed to the opening portion of the cabinet so as to form an air flow passage connecting an interior and an exterior of the cabinet, wherein an area of a perpendicular cross section of a space enclosed with an inner wall of the tubular body increases in directions toward the open ends of the tubular body, the perpendicular cross section being a cross section of the space in a direction perpendicular to a tube axis of the tubular body, wherein, when the inner wall in a cross section of at least one of a first end portion that is near to the one of the open ends and a second end portion that is near to the other of the open ends in the direction perpendicular to the tube axis is viewed from the tube axis, a convex portion at which the inner wall protrudes in a direction away from the tube axis and a concave portion at which the inner wall is recessed in a direction toward the tube axis are repeatedly formed along a circumferential direction of the inner wall, and wherein, in each of the convex portion and the concave portion, a curvature of the inner wall at the at least one of the first end portion and the second end portion is increased and decreased along the circumferential direction of the inner wall.

16. The acoustic apparatus according to claim 15, wherein the convex portion and the concave portion are repeatedly formed on the inner wall of the second end portion that is near to the other of the open ends along the circumferential direction and are not formed on the inner wall of the first end portion that is near to the one of the open ends.

* * * * *